US006898382B2

(12) United States Patent
Shibaki

(10) Patent No.: US 6,898,382 B2
(45) Date of Patent: May 24, 2005

(54) IMAGE FORMING APPARATUS

(75) Inventor: Seiji Shibaki, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/400,483

(22) Filed: Mar. 28, 2003

(65) Prior Publication Data

US 2003/0190169 A1 Oct. 9, 2003

(30) Foreign Application Priority Data

Apr. 8, 2002 (JP) ..... 2002-105851

(51) Int. Cl.[7] ..... G03G 15/00
(52) U.S. Cl. ..... 399/16; 399/18
(58) Field of Search ..... 399/16, 17, 45, 399/14, 21, 81, 371, 367, 395, 18, 22, 405; 271/265.01, 256.02

(56) References Cited

U.S. PATENT DOCUMENTS

| | | | | | |
|---|---|---|---|---|---|
| 5,857,130 | A | * | 1/1999 | Ueda et al. | 399/17 |
| 6,219,507 | B1 | * | 4/2001 | Yoneda et al. | 399/110 |
| 6,353,726 | B1 | * | 3/2002 | Murata et al. | 399/407 |
| 6,385,406 | B1 | * | 5/2002 | Funamizu et al. | 399/16 |
| 6,421,523 | B1 | * | 7/2002 | Kondo et al. | 399/404 |
| 6,490,421 | B1 | * | 12/2002 | McIntyre | 399/15 |
| 2001/0014235 | A1 | * | 8/2001 | Ando et al. | 399/395 |

* cited by examiner

*Primary Examiner*—Anthony Nguyen
(74) *Attorney, Agent, or Firm*—Fitzpatrick, Cella, Harper & Scinto

(57) ABSTRACT

An image forming apparatus includes an image forming unit adapted to form an image on a sheet, a first sensor adapted to detect skew or a folded corner of a sheet being conveyed, a second sensor adapted to detect multiple feeding of sheets being conveyed, and a display adapted to display results of detection of the first sensor and the second sensor.

10 Claims, 12 Drawing Sheets

FIG.11

ABNORMAL SHEETS ARE INCLUDED IN THE BUNDLE OF DISCHARGED SHEETS. CHECK THE FOLLOWING PAGES.

| | | |
|---|---|---|
| ● SKEW | 2ND COPY | PAGE 3 |
| ● MULTIPLE FEEDING | 5TH COPY | PAGE 8 |

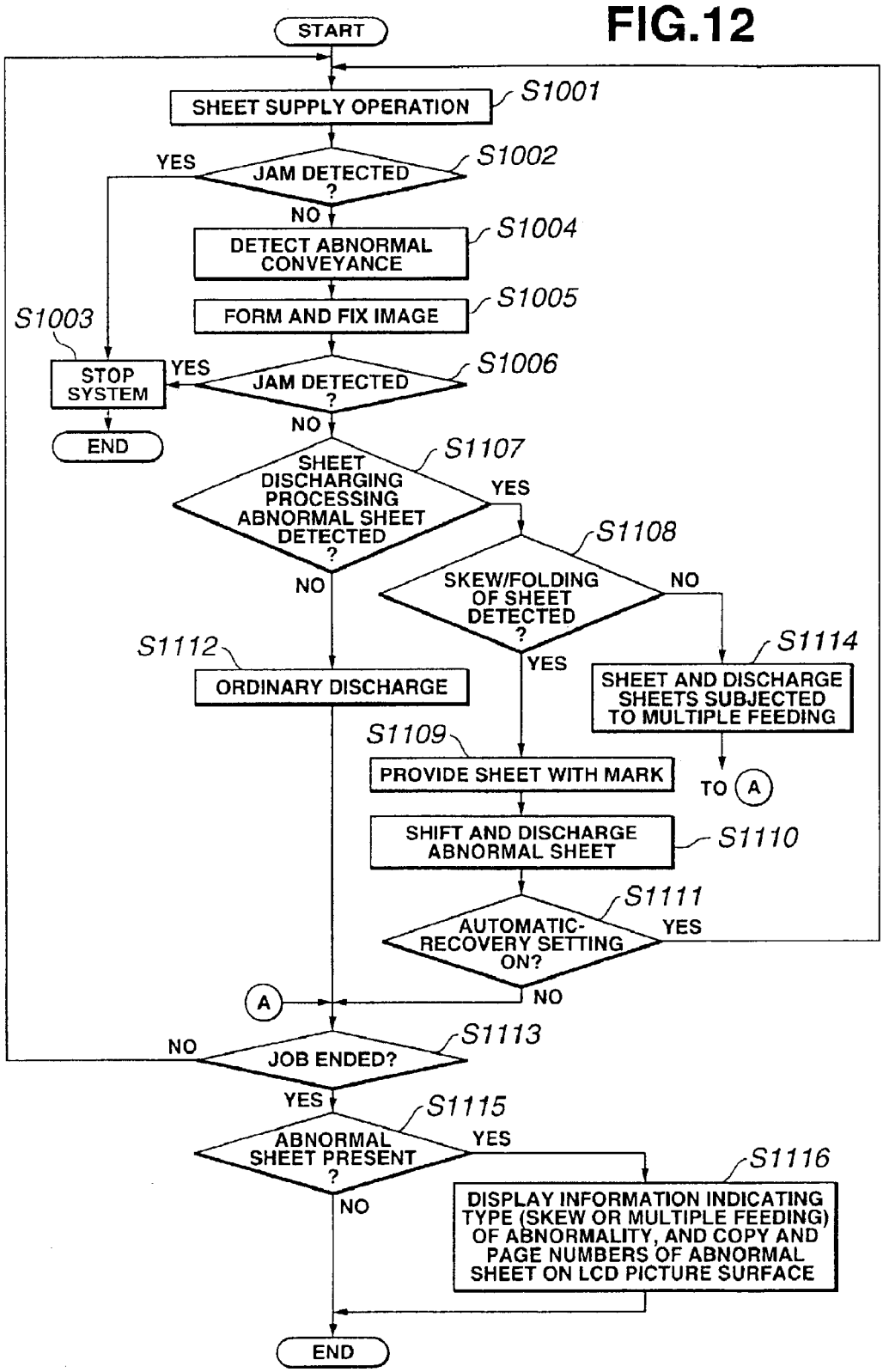
FIG.12
START
SHEET SUPPLY OPERATION
S1001
JAM DETECTED ?
S1002
YES
NO
DETECT ABNORMAL CONVEYANCE
S1004
FORM AND FIX IMAGE
S1005
S1003
STOP SYSTEM
YES
JAM DETECTED ?
S1006
NO
END
SHEET DISCHARGING PROCESSING ABNORMAL SHEET DETECTED ?
S1107
YES
NO
SKEW/FOLDING OF SHEET DETECTED ?
S1108
NO
YES
S1112
ORDINARY DISCHARGE
S1114
SHEET AND DISCHARGE SHEETS SUBJECTED TO MULTIPLE FEEDING
TO A
S1109
PROVIDE SHEET WITH MARK
SHIFT AND DISCHARGE ABNORMAL SHEET
S1110
AUTOMATIC-RECOVERY SETTING ON?
S1111
YES
NO
A
JOB ENDED?
S1113
NO
YES
ABNORMAL SHEET PRESENT ?
S1115
YES
NO
S1116
DISPLAY INFORMATION INDICATING TYPE (SKEW OR MULTIPLE FEEDING) OF ABNORMALITY, AND COPY AND PAGE NUMBERS OF ABNORMAL SHEET ON LCD PICTURE SURFACE
END

IMAGE FORMING APPARATUS

BACKGROUND OF THE INVENTION

1. Field of the Invention

The present invention relates to an image forming apparatus for forming an image on a sheet by conveying the sheet, and more particularly, to an image forming apparatus in which, when a sheet in an abnormal state is discharged, the user can discriminate that sheet from normal sheets.

2. Description of the Related Art

In conventional image forming apparatuses, an image is formed on a sheet, and then the sheet is discharged. Such an image forming apparatus detects, when a sheet being conveyed is jammed in an abnormal state, i.e., when a so-called jam is occurs, the jam using a jam detection sensor, and immediately stops the operation.

However, a sheet that is not jammed even in an abnormal state is discharged without any notification. For example, such a sheet has the problem that an image is obliquely formed on the sheet due to skew of the sheet, a corner of the sheet is folded, or a plurality of sheets are superposed.

Since such a sheet is discharged and mounted as a normal sheet even in an abnormal state, the user does not notice the problem. Even if the user knows that such a sheet is in an abnormal state, the user's action differs depending on the type of abnormality. That is, when a plurality of sheets are conveyed in a superposed state, it is only necessary for the user to extract blank sheets from the bundle of discharged sheets. On the other hand, when the sheet skews or a corner of the sheet is folded, it is necessary for the user to extract the sheet from the bundle of discharged sheets, and insert a normal sheet having an image formed thereon into the extracted position.

SUMMARY OF THE INVENTION

It is an object of the present invention to provide an image forming apparatus having a function of identifying a sheet discharged in an abnormal state.

According to one aspect of the present invention, an image forming apparatus includes an image forming unit adapted to form an image on a sheet, a first sensor adapted to detect skew or a folded corner of a sheet being conveyed, a second sensor adapted to detect multiple feeding of sheets being conveyed, and a notification unit adapted to notify results of detection of the first sensor and the second sensor.

In one embodiment, the notification unit notifies a position where the skewed sheet or the sheet having the folded corner is mixed, and a position where the sheets subjected to multiple feeding are mixed, in a bundle of discharged sheets.

In another embodiment, the notification unit performs notification by means of display.

In still another embodiment, the notification unit notifies a page where the skewed sheet or the sheet having the folded corner is mixed, and pages where the sheets subjected to multiple feeding are mixed.

In yet another embodiment, the notification unit notifies a sheet bundle where the skewed sheet or the sheet having the folded corner is mixed, and a sheet bundle where the sheets subjected to multiple feeding are mixed, from among a plurality of bundles of discharged sheets.

In yet a further embodiment, the apparatus further includes a discharge unit adapted to shift and discharge the sheet for which the first sensor has detected skew or the folded corner, and the sheets for which the second sensor has detected multiple feeding.

In still another embodiment, the apparatus further includes an image provision unit adapted to provide the sheet for which the first sensor has detected skew or the folded corner with a predetermined image.

In still another embodiment, the image forming unit performs an operation of recovering image formation, in accordance with detection of skew or the folded corner by the first sensor.

In still another embodiment, the image forming unit does not perform an operation of recovering image formation, when multiple feeding has been detected by the second sensor.

According to another aspect of the present invention, a sheet processing apparatus includes a first sensor adapted to detect skew or a folded corner of a sheet being conveyed, a second sensor adapted to detect multiple feeding of sheets being conveyed, and a notification unit adapted to notify results of detection of the first sensor and the second sensor.

The foregoing and other objects, advantages and features of the present invention will become more apparent from the following description of the preferred embodiment taken in conjunction with the accompanying drawings.

BRIEF DESCRIPTION OF THE DRAWINGS

FIG. 6A is a plan view illustrating arrangement of the skew detection sensor; and FIG. 6B is a side view illustrating arrangement of the skew detection sensor as seen along a sheet conveying direction;

FIG. 11 is a diagram illustrating a message display when abnormal sheets are detected; and FIG. 12 is a flowchart illustrating an image forming operation.

DESCRIPTION OF THE PREFERRED EMBODIMENT

A description will now be provided of a copier, serving as an image forming apparatus, according to a preferred embodiment of the present invention with reference to the drawings. Image forming apparatuses include copiers, facsimile apparatuses, printers, composite apparatuses in which these apparatuses are combined, and the like. The present invention is applied not only to copiers, but also to facsimile apparatuses, printers, composite apparatuses and the like.

(Explanation of the Configuration and the Operation of the Copier)

Figure 1:
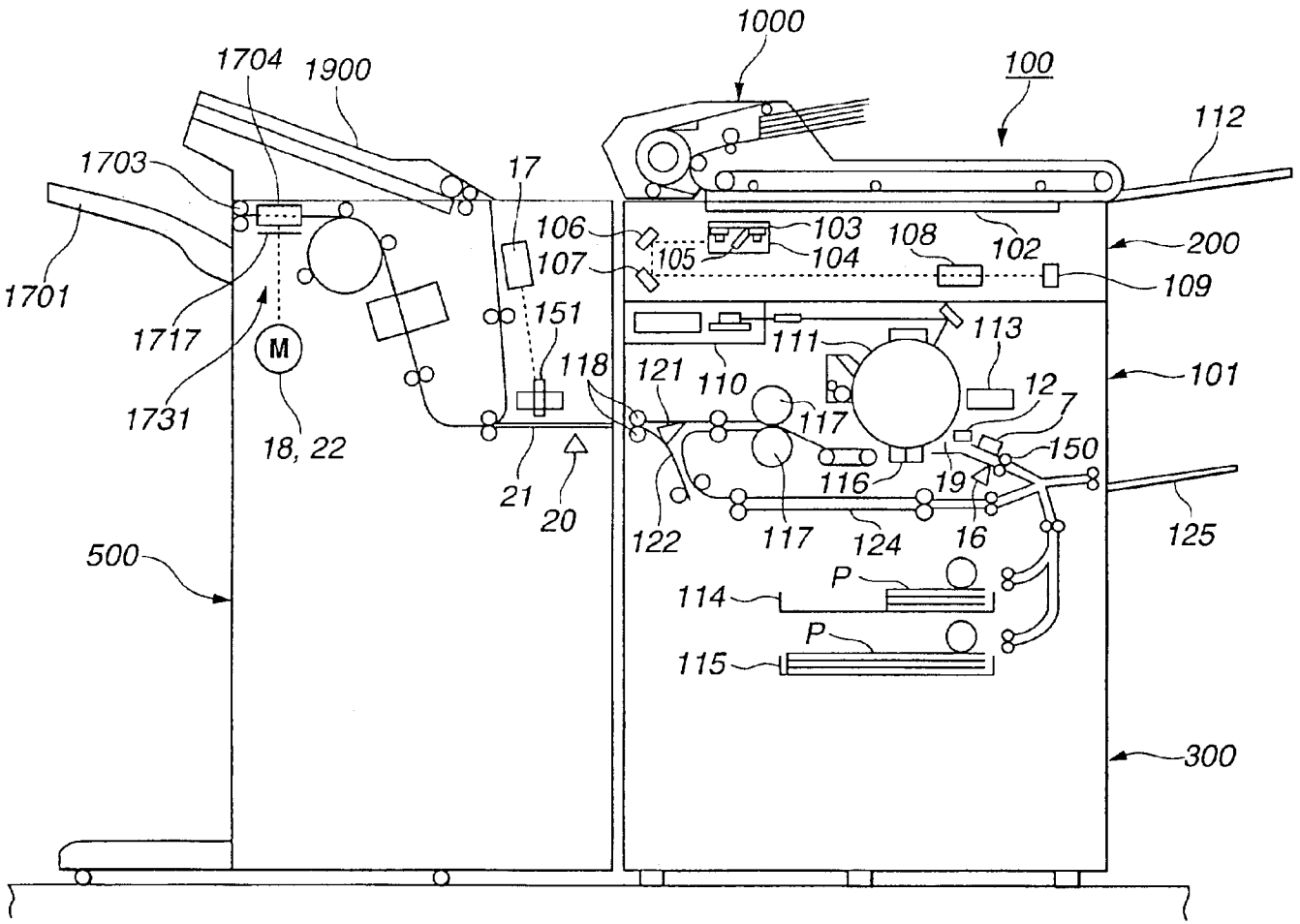
FIG. 1 is a cross-sectional view illustrating a copier, serving as an image forming apparatus, in which the copier is cut along a sheet conveying direction, according to an embodiment of the present invention.

FIG. 1 illustrates the entire configuration of a copier 100 according to the embodiment, and is a cross-sectional view obtained by cutting the copier along the sheet conveying direction. The copier 100 includes an original-feeding device 1000, an image reader 200, a printer 300, a finisher 500, and the like. The original-feeding device 1000 sequentially conveys sheets of an original set by the user starting from the leading page from the left to the right, in the state shown in FIG. 1, on platen glass 102 after causing the sheets to pass through a curved path, and thereafter discharges the sheets onto a discharged-sheet tray 112. At that time, a scanner unit 104 remains to stop by being held at a predetermined position.

When the original passes from the left to the right on the scanner unit 104 that remains to stop, a lamp 103 of the scanner unit 104 illuminates the original. Reflected light from the original is reflected by mirrors 105, 106 and 107, and is guided to an image sensor 109 after passing through a lens 108. By guiding of the reflected light from the original to the image sensor 109, the image on the original is read by the image reader 200. Such a reading method is generally called flow reading.

Original-reading methods include fixed reading in addition to flow reading. In fixed reading, the scanner unit 104 reads an image of an original that has been supplied from the original feeding device 1000 and temporarily stops on the platen glass 102 by moving from the left to the right in the state shown in FIG. 1.

Image information of the original guided to the image sensor 109 is subjected to image processing in the image sensor 109, and the resultant data is transmitted to an exposure control unit 110. The exposure control unit 110 emits a laser beam corresponding to an image signal. The laser beam illuminates a photosensitive drum 111 to form an electrostatic latent image thereon. The electrostatic latent image on the photosensitive drum 111 becomes a toner image by a toner, serving as a developer, in a developing unit 113. The toner image on the photosensitive drum 111 is transferred onto a sheet fed from one of cassettes 14 and 115, a manual sheet feeding unit 125, and a duplex conveying path 124 (hereinafter merely termed a "sheet") by a transfer unit 116.

The sheet having the toner image transferred thereto is fed to a fixing unit 117. The fixing unit 110 fixes the toner image on the sheet. The sheet passing through the fixing unit 117 is first guided to a path 122 by a flapper 121. When the trailing edge of the sheet passes through the flapper 121, the sheet is subjected to switchback conveyance, so that the sheet is guided to the flapper 121 by making the former trailing edge the new leading edge, and is further guided to a pair of discharge rollers 118. Then, the sheet is discharged from the printer 300 by the pair of discharge rollers 118 in a state in which the surface having the transferred toner image is placed downward (in a face-down state).

A hard sheet, such as a sheet for an overhead projector (OHP), is mostly supplied from the manual sheet feeding unit 125. After fixing a toner image on an OHP sheet supplied from the manual sheet feeding unit 125, the OHP sheet is discharged from the pair of discharge rollers 118 without being guided to the path 122, in a state in which the surface having the transferred image is placed upward (in a face-up state).

When forming images on both surfaces of a sheet, the sheet is directly guided from the fixing unit 117 to the pair of discharge rollers 118. Immediately after the trailing edge of the sheet passes through an upper portion of the flapper 121, the sheet is subjected to switchback conveyance, so that the sheet is guided to the flapper 121, and is further guided to a duplex conveyance path 124.

The sheet discharged from the pair of discharge rollers 118 is fed to the finisher 500. The finisher 500 performs, for example, post-processing, such as shifting processing, binding processing, punching or the like. An inserter 1900 is provided above the finisher 500. The finisher 500 feeds a cover sheet, insertion sheets and the like to the finisher 500.

A stamp 151 is disposed near the entrance of the finisher 500. The stamp 151 provides an abnormal sheet (to be described later) with an "NG" mark so that the abnormal sheet can be identified. The abnormal sheet is temporarily stopped in order to be provided with the "NG" mark. A shifter 1704 for shifting the abnormal sheet in a direction crossing the sheet conveying direction is provided between the stamp 151 and a pair of discharge rollers 1703 of the finisher 500. The pair of discharge rollers 1703 is contactable/separable.

(Explanation of Control Units)

Figure 2:
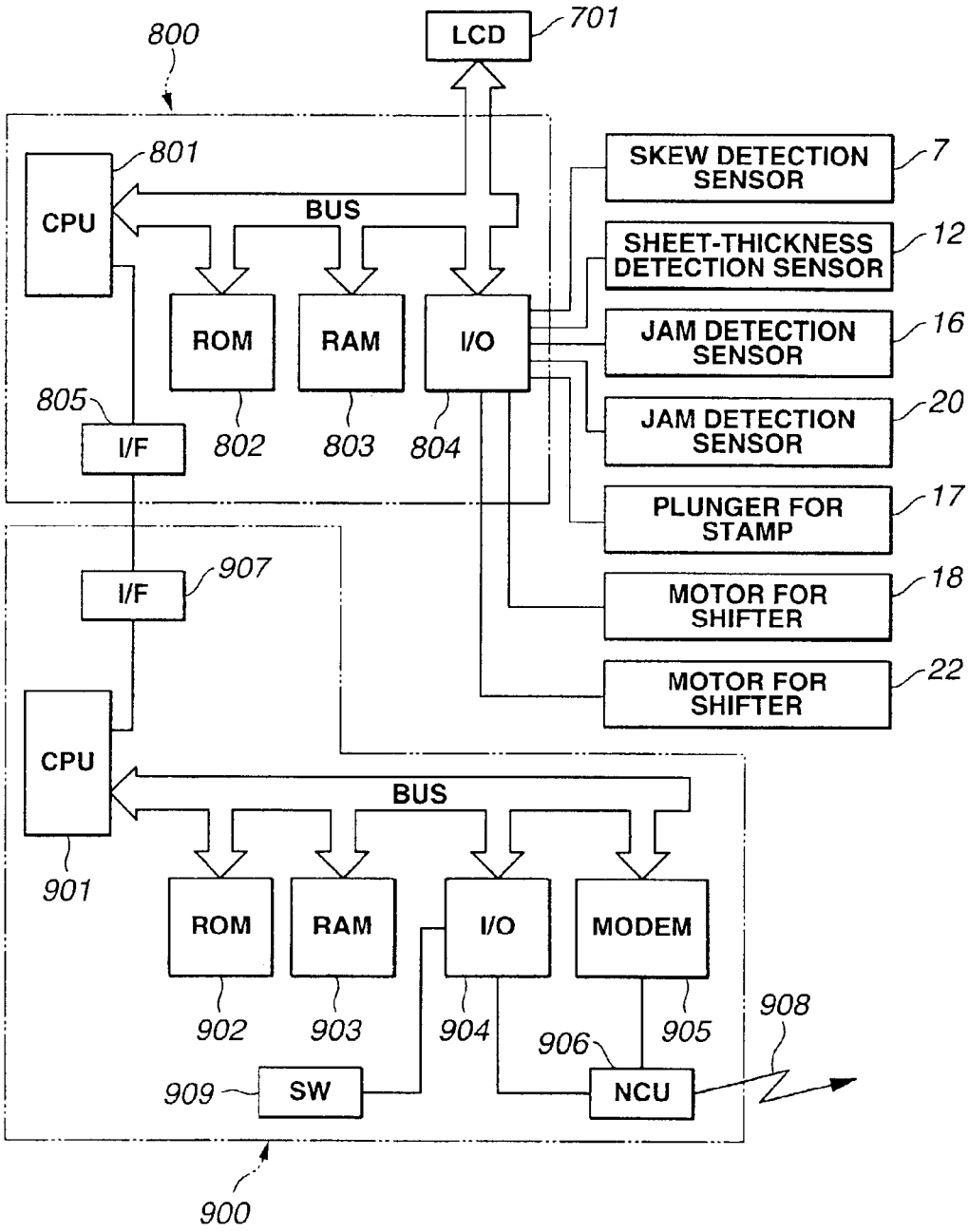
FIG. 2 is a block diagram illustrating control of the copier shown in FIG. 1.

FIG. 2 is a block diagram illustrating a copying control unit 800 and a communication control unit 900 of the copier 100 of the embodiment. The copying control unit 800 controls a copying operation of a copier main body 101 (see FIG. 1). The communication control unit 900 controls communication with an external communication network.

A central processing unit (hereinafter abbreviated as a "CPU") 801 controls the entire copier. A read-only memory (hereinafter abbreviated as a ("ROM") 802 stores control procedures (control programs) for the copier main body 101, and the like.

The CPU 801 controls respective units connected via a bus in accordance with control procedures stored in the ROM 802. The CPU 801 also receives input signals from various keys on an operation panel 600 (to be described later) and transmits an output signal for displaying information necessary for a message display 701 on the operation panel 600 to the message display 701, via a bus or an appropriate I/O (input/output unit) (not shown).

An random access memory (hereinafter abbreviated as a "RAM") 803 is a main storage device used, for example, for storing input data, or as a storage region for an operation. The RAM 803 also operates as storage means for telephone numbers and the like necessary for staring communication with external apparatuses.

An input/output IC (hereinafter abbreviated as an "I/O") 804 receives a signal from a sensor (not shown) of the fixing unit 117 (see FIG. 1), a skew detection sensor 7 for detecting skew of a sheet, a sheet-thickness detection sensor 12 for detecting sheets fed in a superposed state, a jam detection sensors 16 or 20 for detecting occurrence of a sheet jam, or the like, and transmits the received signal to the CPU 801. The I/O 804 also outputs a control signal from the CPU 801 for a load, such as a main motor, a stamp plunger 17 for operating the stamp 151, a motor 18 or 22 for operating the shifter 1704, or the like.

The communication control unit 900 for controlling communication with an external communication network 908 controls communication through a CPU 901. A ROM 902 stores programs for communication control, connection procedures, and the like. The communication control unit 900 is connected to the copying control unit 800 of the copier main body 101 via a transfer unit comprising RS-232C interfaces 805 and 907.

When data transfer from the copying control unit 800 of the copier main body 101 via the RS-232C interface 907 is performed, the communication control unit 900 temporarily stores the transferred data in a RAM 903, serving as dedicated communication-data storage means. Upon completion of the data transfer, the communication control unit 900 performs communication-network connection with an external apparatus by controlling a network control unit (hereinafter abbreviated as an "NCU") 906 using the CPU 901. Upon completion of the network connection, the communication control unit 900 transfers the data to the external apparatus via the NCU 906.

When data is transferred from an external apparatus, the communication control unit 900 temporarily stores the transferred data in the RAM 903, and then transfers the data to the copying control unit 800 of the copier main body 101 via the RS-232C interfaces 805 and 907 in accordance with a request from the copying control unit 800 of the copier main body 101. A rotary switch 909 is for setting telephone numbers of respective communication partners, an ID number and a password of the communication control unit 900, and the like.

(Explanation of the Operation Panel)

Figure 3:
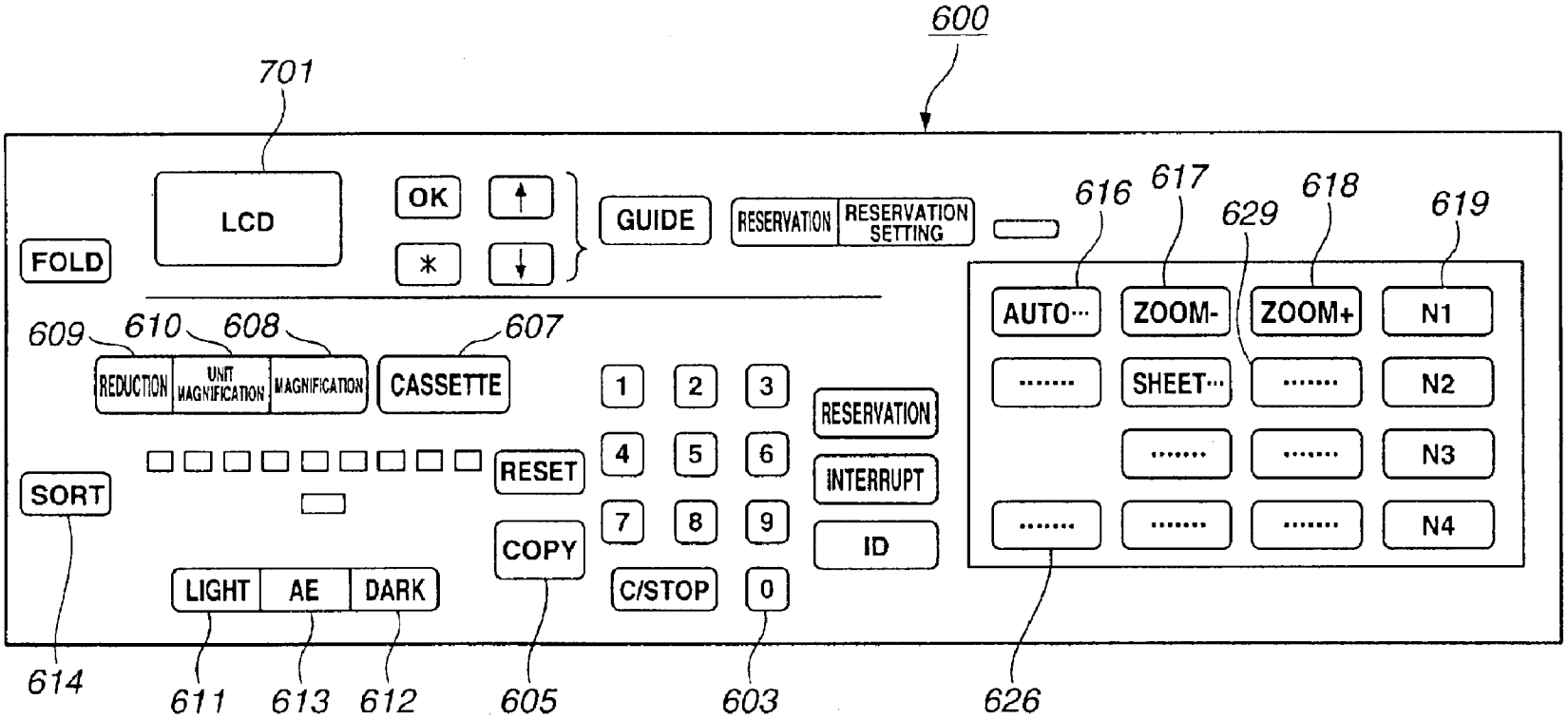
FIG. 3 is a diagram illustrating an external appearance of an operation panel.

FIG. 3 is a diagram illustrating an external appearance of the operation panel 600 provided in the copier main body 101. A copying start key 605 is depressed when starting a copying operation. A ten-digit keypad 603 is for setting the number of copies. Copying-density keys 611 and 612 are for manually adjusting a copying density. An AE (automatic density adjustment) key 613 is for automatically adjusting the copying density in accordance with the density of an original, or for releasing AE and switching density adjustment to a manual operation.

A copying-sheet selection key 607 is for selecting one of the cassette 114, the cassette 115 and the manual sheet feeding unit 125. This copying-sheet selection key 607 is also for selecting APS (automatic sheet-cassette selection) when an original is mounted on the original-feeding device 1000. When APS is selected, a cassette having the same size as the original can be automatically selected.

A unit-magnification key 610 is used when obtaining a copy of unit magnification (original size). An automatic magnification varying key 616 is for assigning automatic reduction/magnification of an image of an original in accordance with the size of an assigned transfer sheet. A recovery key 619 is for determining, when abnormal sheets are generated, whether or not sheets whose number equals the number of the abnormal sheets are to be added and image formation is to be performed on the sheets. When the result of the determination is affirmative, the copier 100 automatically adds sheets whose number equals the number of the abnormal sheets and performs image formation on the added sheets. A duplex key 626 is for selecting one of a duplex copying operation from a simplex original, a duplex copying operation from a duplex original, and a simplex copying operation from a duplex original.

A cover-sheet-mode setting key 629 is used when forming a cover sheet and a back cover sheet, or inserting an insertion sheet from the inserter 1900. A sheet-discharge-method selection key 614 is for selecting a discharge method in each of stapling sorting, sorting, grouping and shifting. The sheet-discharge-method selection key 614 is also for selecting, when the finisher 500 is connected, one of a stapling sorting mode, a sorting mode, a grouping mode and a shifting mode for sheets, or for releasing the selected mode.

The message display 701 on the display unit 600 is an LCD (liquid-crystal display)-type display for displaying information relating to a copying operation and communication, and displays characters and figures with a total size comprising 96×129 dots. The message display 701 displays, for example, the number of copies set by the ten-digit keypad 603, a copying magnification set by a magnification varying key 608 or 609, the unit-magnification key 610, or a zoom key 617 or 618, a sheet size selected by the copying-sheet selection key 607, a message indicating the state of the copier main body 101, a guide message indicating an operation procedure, and the contents of various mode settings.

When an abnormal sheet is detected, the message display 701 can display, by being controlled by the CPU 801, which sheet counted from the leading sheet of sheets discharged and mounted on a tray 1701 is abnormal, and the type of abnormality (skew, a folded corner, or multiple feeding).

(Explanation of the Shifter)

Figure 4:
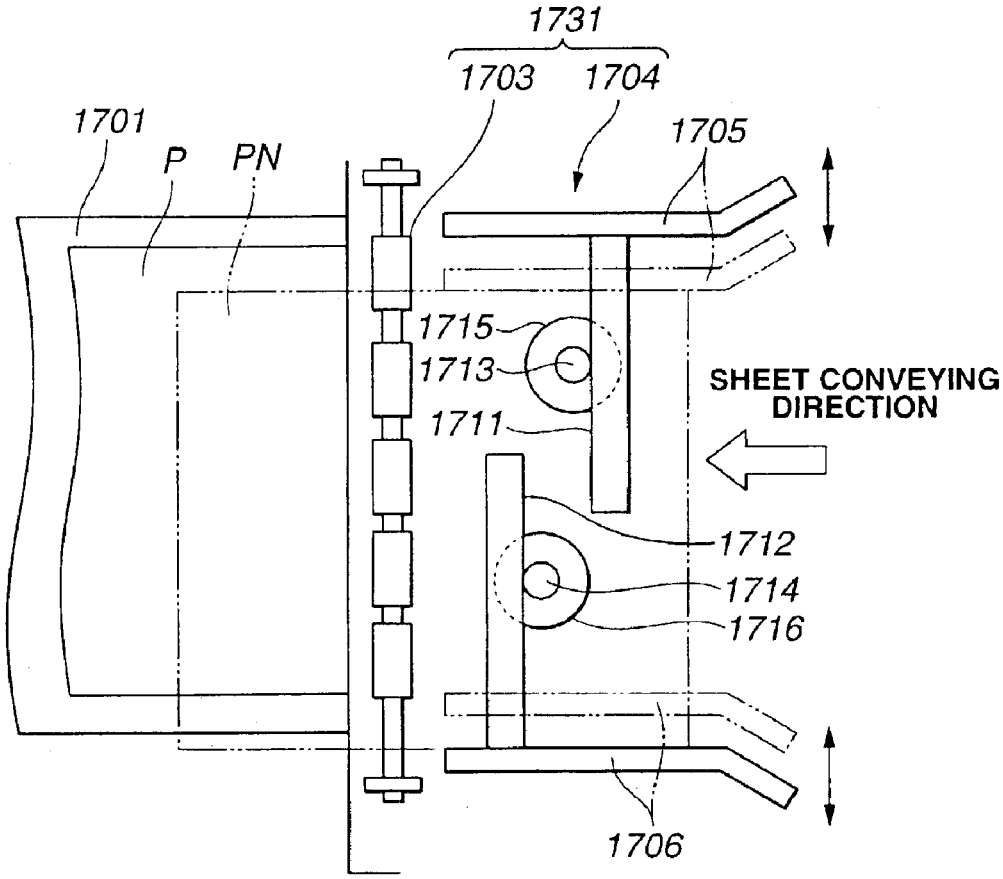
FIG. 4 is a plan view illustrating a shifter.

As shown in FIG. 4, the shifter 1704 includes a pair of parallel regulating plates 1705 and 1706 positioned above an intermediate tray 1717 (see FIG. 1). The pair of regulating plates 1705 and 1706 has racks 1711 and 1712, respectively. Pinions 1713 and 1714 rotated by motors 1715 and 1716 mesh with the racks 1711 and 1712, respectively. Each of the pair of regulating plates 1705 and 1706 performs parallel movement between a position indicated by solid lines and a position indicated by broken lines by the motors 1715 and 1716, respectively. Accordingly, when the skew detection sensor 7 or the sheet-thickness detection sensor 12 (both to be described later) detects an abnormal sheet, the shifter 1704 operates by the control of the CPU 801.

Although the shifter 1704 shown in FIG. 4 has the pair of regulating plates 1705 and 1706, the shifter 1704 may have only regulating plate.

Usually, the pair of regulating plates 1705 and 1706 waits at the positions indicated by the solid lines that are most separated from each other, so that a sheet P can be discharged onto a position indicated by solid lines on the tray 1701. When the skew detection sensor 7 or the sheet-thickness detection sensor 12 shown in FIG. 1 detects an abnormal sheet, the CPU 800 separates a pair of discharge rollers 1703 in pressure contact with each other. When an abnormal sheet PN is fed to the intermediate tray and enters between the pair of discharge rollers 1703 separated from each other, to assume a state of being freely movable on the intermediate tray 1717, a control signal is transmitted from the CPU 801 to the motor 1715 (or 1716).

The motor 1715 (or 1716) that has received the control signal revolves to move the regulating plate 1705 (or 1706) to the position indicated by the broken lines. The regulating plate 1705 (or 1706) moved to the position indicated by the broken lines moves (shifts) the abnormal sheet PN in a direction crossing the sheet conveying direction on the intermediate tray 1717. The abnormal sheet PN moves to a position indicated by broken likes. Then, the CPU 800 causes the pair of discharge rollers 1703 separated from each other to be in pressure contact with each other to rotate while grasping the abnormal sheet PN. The abnormal sheet PN is discharged onto the tray 1701 by the pair of discharge rollers 1703, and is mounted in a state of shifting in a direction crossing the sheet conveying direction.

Figure 6A:
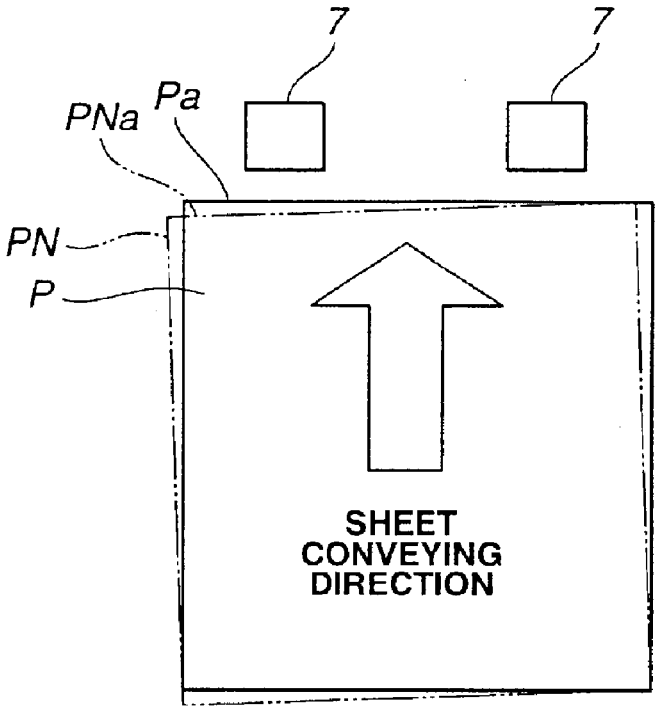
FIGS. 6A and 6B are diagrams illustrating arrangement of a skew detection sensor.

The direction of shift is preferably a skew direction of the abnormal sheet PN. For example, as shown in FIG. 6A, when the abnormal sheet PN passing through the skew detection sensor 7 is inclined toward a lower left direction as indicated by broken lines, the shifter 1704 can more easily shift the abnormal sheet PN by shifting it downward, as indicated by broken lines in FIG. 4. By thus shifting the abnormal sheet PN so as to be adjusted with the skew direction of the abnormal sheet PN, the shifter 1704 can assuredly shift the abnormal sheet PN.

In the above-described configuration, the shifter 1704, the pair of discharge rollers 1703 and the intermediate tray 1717 constitute sheet discharge unit (discharge means) 1731.

(Explanation of Another Shifter)

Figure 5:
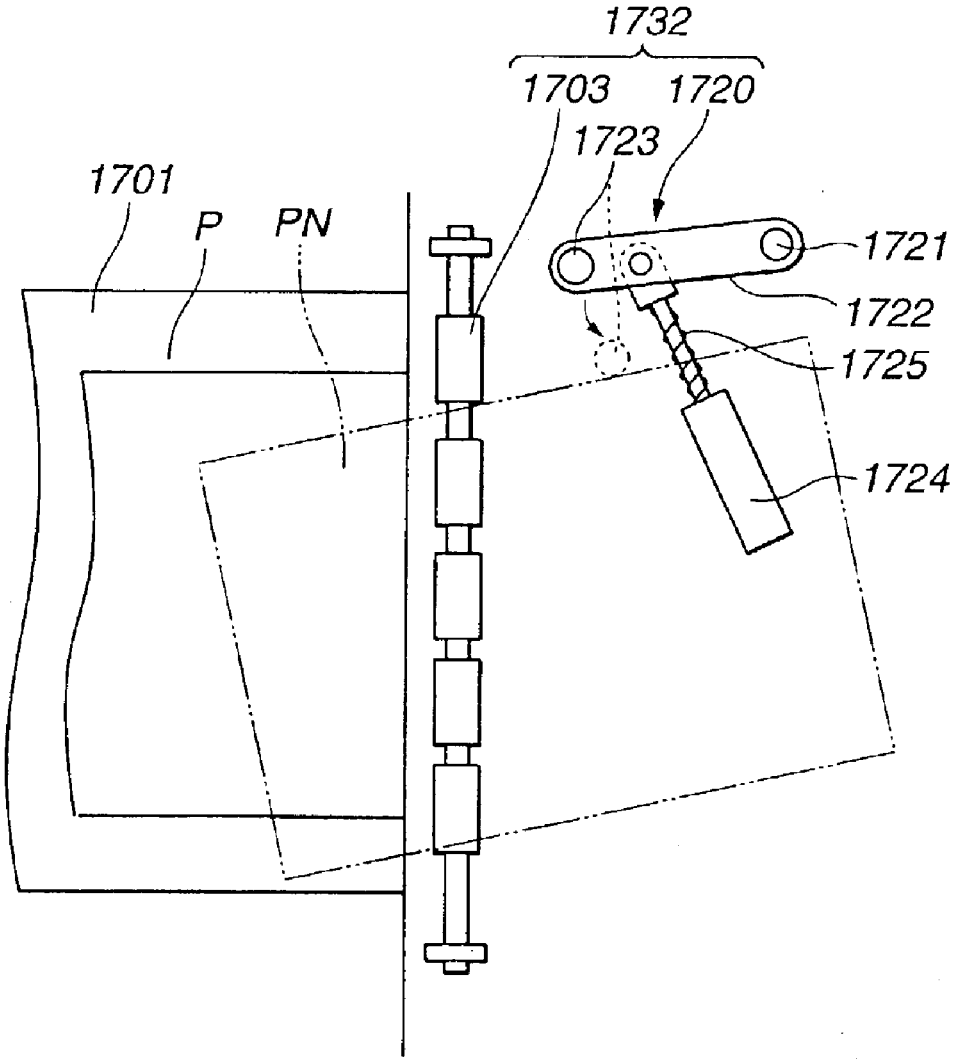
FIG. 5 is a plan view illustrating another shifter.

The above-described shifter 1704 causes an abnormal sheet to perform parallel movement in a direction crossing the sheet conveying direction. However, as in the case of a shifter 1720 shown in FIG. 5, a sheet may be obliquely discharged. The shifter 1720 includes a rotating link 1722 rotating around a central shaft 1721 on the intermediate tray 1717 (see FIG. 1), a sheet pressing shaft 1723 provided at a rotation end of the rotating link 1722, a plunger 1724 for rotating the rotating link 1722, and the like. The rotating link 1722, the sheet pressing shaft 1723 and the like may be provided at each end of a sheet.

Usually, the sheet pressing shaft 1723 waits at a position indicated by solid lines where it does not contact a sheet. When the skew detection sensor 7 or the sheet-thickness detection sensor 12 detects an abnormal sheet, the CPU 801 separates the pair of discharge rollers 1703 in pressure contact with each other. When the abnormal sheet is fed to the intermediate tray 1717 and enters between the separated pair of discharge rollers 1703 to assume a state of being freely movable on the intermediate tray 1717, a control signal is transmitted from the CPU 801 to the plunger 1724.

The plunger 1724 that has received the control signal operates against a spring 1725, to rotate the rotating link 1722 in a counterclockwise direction and press a side portion of the sheet with the sheet pressing shaft 1723. The sheet pressing shaft 1723 moved to a position indicated by broken lines makes the abnormal sheet oblique with respect to the sheet conveying direction on the intermediate tray 1717. The abnormal sheet is inclined to a position indicated by broken lines. Then, the CPU 800 causes the separated pair of discharge rollers 1703 to be in pressure contact with each other to grasp the abnormal sheet, to rotate the pair of discharge rollers 1703. The abnormal sheet PN is obliquely discharged onto the tray 1701 by the pair of discharge rollers 1703 and mounted in a state of being oblique with respect the normal sheet P.

The direction to make the sheet oblique is preferably the same as the skew direction of the abnormal sheet. It is thereby possible to assuredly cause the abnormal sheet to be oblique.

In the above-described configuration, the shifter 1720, the pair of discharge rollers 1703, and the intermediate tray 1717 constitute sheet discharge unit (discharge means) 1732.

(Explanation of Jam Detection)

Each of the jam detection sensors 16 and 20 shown in FIG. 1 detects a passing sheet P. The jam detection sensor 16 present at an upstream portion is provided at a conveying path 19. The lam detection sensor 16 present at a downstream portion is provided at a conveying path 21 within the finisher 500. When the sheet P fed from the cassette 114 or 115 is not detected by the jam detection sensor 16 even after the lapse of a predetermined time period after having been fed, the CPU 801 shown in FIG. 2 determines that a jam occurs at a downstream portion from the jam detection sensor 16, displays the location of the jam on the message display 701, and urgently stops the apparatus. When the jam detection sensor 16 at the upstream side detects the sheet, but the jam detection sensor 20 at the upstream side does not detect the sheet, the CPU 801 determines that a jam occurs at a portion between the jam detection sensor 16 and the jam detection sensor 20, displays the location of the jam on the message display 701, and urgently stops the apparatus.

Sometimes, a jam occurs generated at the jam detection sensor 16 or 20, and therefore the jam detection sensor 16 or 20 remains to detect the sheet. In such a case, the CPU 801 determines that a jam occurs when a signal indicating detection of the sheet is being received for at least a predetermined time period, displays the location of the jam on the message display 701, and urgently stops the apparatus.

The number of jam detection sensors is not limited to two, but may be any appropriate number. As the number of jam detection sensors is large, a jam can be more assuredly detected.

(Explanation of Detection of an Abnormal Sheet)

Figure 6B:
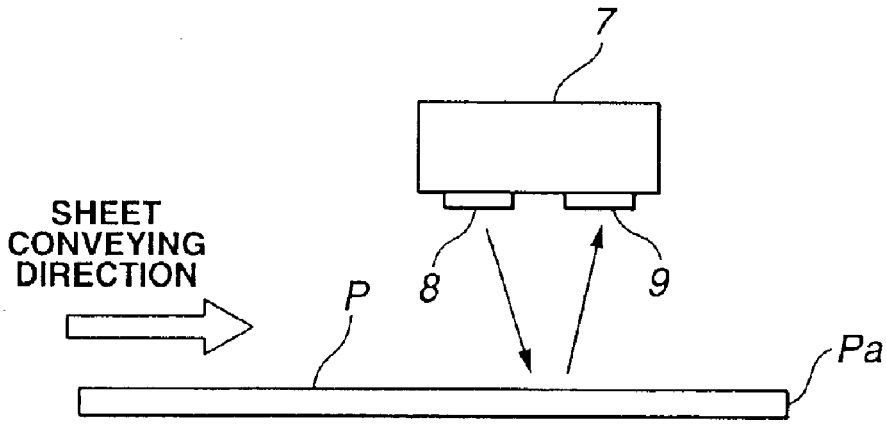

A description will now be provided of the skew detection sensor 7 disposed at the conveying path 19 between a pair of registration rollers 150 and a transfer unit 116 shown in FIG. 1, with reference to FIGS. 6A and 6B. As shown in FIG. 6A, two skew detection sensors 77 detect skew or a folded portion of a sheet. The two skew detection sensors 7 are arranged in a direction orthogonal to the sheet conveying direction at the conveying path 19 between the pair of registration rollers 150 and the transfer unit 116, i.e., at portions downstream from the pair of registration rollers 150. The number of the skew detection sensors 7 is not limited to two, provided that a plurality of skew detection sensors are arranged.

As shown in FIG. 6B, the skew detection sensor 7 is an optical sensor including a light emitting unit 8 for emitting light, and a photosensing unit 9 for sensing reflected light when the light emitted from the light emitting unit 8 is reflected.

In FIG. 6A, when a sheet P is rectilinearly conveyed as indicated by solid lines, the leading edge (the downstream-side end) Pa of the sheet P is orthogonal to the sheet conveying direction. Accordingly, the two skew detection sensors 77 simultaneously detect the leading edge Pa of the sheet P. In this case, the CPU 801 (see FIG. 2) determines that the conveyed sheet P is normally conveyed since the CPU 801 simultaneously receives sheet detection signals from the two skew detection sensors 77.

In FIG. 6A, when a sheet PN is obliquely conveyed as indicated by broken lines, the leading edge PNa of the sheet PN obliquely crosses the sheet conveying direction. Accordingly, the two skew detection sensors 77 do not simultaneously detect the leading edge PNa of the sheet PN when the sheet PN skews. That is, after one of the skew detection sensor 7 has detected the leading edge of the sheet PN, the other skew detection sensor 7 detects the leading edge of the sheet PN. The CPU 801 determines that the conveyed sheet PN is in an abnormal state because, after the lapse of a predetermined time period after receiving a sheet detection signal from one of the skew detection sensors 77, a sheet detection signal from the other skew detection sensor 7 is received.

Figure 7:
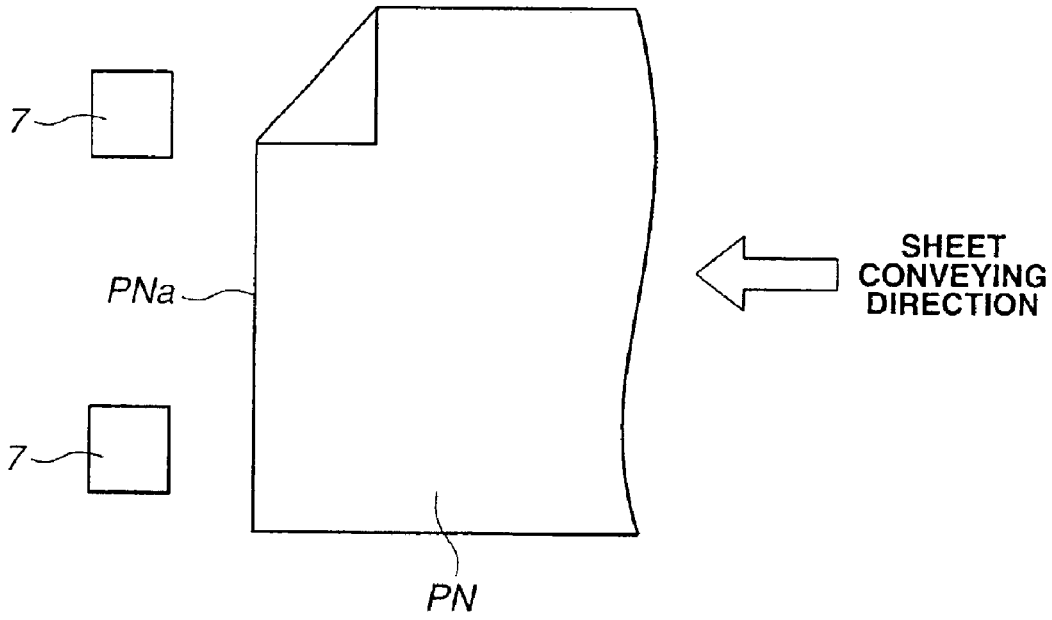
FIG. 7 is a plan view when the skew detection sensor detects a folded sheet.

When the leading edge of the sheet PN is folded as shown in FIG. 7, also, the two skew detection sensors 77 do not simultaneously detect the leading edge PNa of the sheet PN. That is, after one of the two skew detection sensors 77 has detected the leading edge of the sheet PN, the other skew detection sensor 7 detects the leading edge of the sheet PN. In this case, also, the CPU 801 determines that the conveyed sheet PN is in an abnormal state because, after the lapse of a predetermined time period after receiving a sheet detection signal from one of the skew detection sensors 77, a sheet detection signal from the other skew detection sensor 7 is received.

If a sheet is fed to the transfer unit 116 in a skewed state, and a toner image is transferred onto the sheet, the toner image is transferred obliquely with respect to the sheet, indicating that a normal copying operation is not performed. When a toner image is transferred onto a folded sheet, also, a normal copying operation is not performed. Accordingly, these sheets are handled as abnormal sheets.

When the CPU 801 determines that the sheet fed to the conveying path 19 is an abnormal sheet, the CPU 801 provides the abnormal sheet PN with a mark by operating the plunger 17 of the stamp 151.

Figure 10:
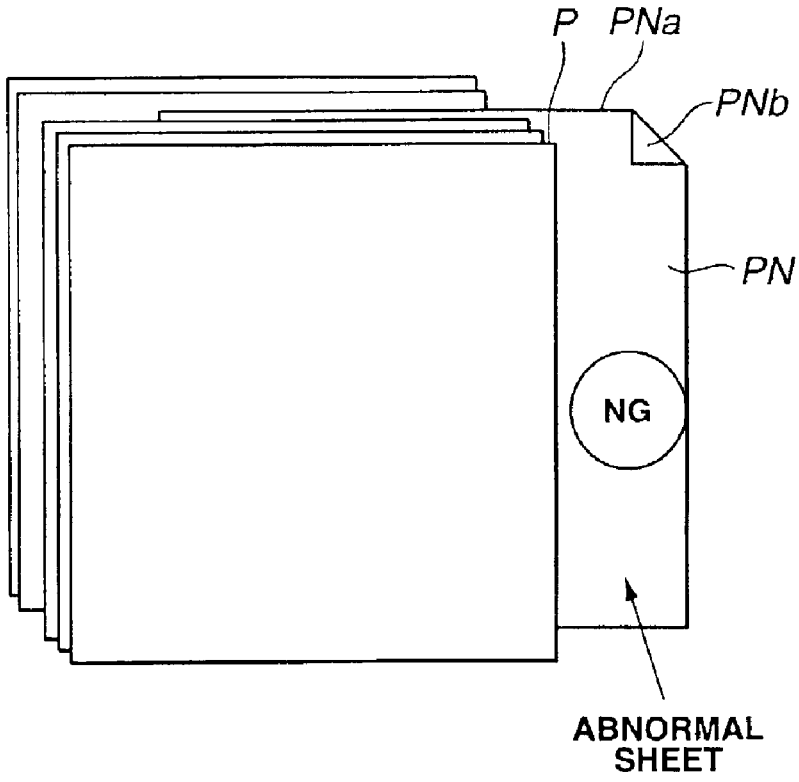
FIG. 10 is a diagram illustrating a state in which a folded sheet is mounted on a tray by being mixed with normal sheets.

The CPU 801 also shifts the abnormal sheet in a direction crossing the sheet discharging direction by operating the shifter 1704, so that the abnormal sheet can be visually discriminated from normal sheets. In this case, the shifter 1704 can more easily shift the sheet when the sheet is shifted to a side of skew or a folded portion. Particularly, when the sheet is folded, as shown in FIG. 10, the concerned sheet can be out of other sheets, so that it is possible to instantaneously determine that the sheet PN is folded. By making a folded portion PNb out of other sheets, a sheet mounting state is not disturbed, and therefore mountability of sheets is not degraded.

The CPU 801 also displays which sheet on the tray 701 is an abnormal sheet on the message display 701 by displaying the number counted to the abnormal sheet from the leading sheet or from the last sheet of sheets discharged on the tray 701, or, as shown in FIG. 11, displays the page number and the copy number of the abnormal sheet such as skewed sheet on the message display 701.

As described above, the copier 100 can cause the user to discriminate between abnormal sheets and normal sheets, identify the position of an abnormal sheet in a bundle of discharged sheets, and identify whether an abnormal sheet is a skewed sheet or belongs to sheets subjected to multiple feeding, by providing the abnormal sheet with a mark, performing shifted (or oblique) discharge of the abnormal sheet, and performing message display.

The copier 100 not necessarily perform all of marking on an abnormal sheet, shifted (or oblique) discharge of the abnormal sheet, and message display. Even if only at least one of the above-described operations is performed, it is possible to cause the user to identify an abnormal sheet from normal sheets. In such a case, it is only necessary for the copier 100 to have a necessary mechanism for performing the at least one operation.

Although the skew detection sensor 7 is an optical sensor in the foregoing description, a density detection sensor may also be used instead of the optical sensor. A density detection sensor (not shown) detects densities of the conveying paths 19 and 21 until a sheet is conveyed. When a sheet is fed, the density sensor detects that the density has changed by detecting the density of the sheet. The CPU 801 determines that the sheet has been conveyed because a density signal transmitted from the density detection sensor has changed. In order to compare densities, a density reference (not shown) may be used instead of the conveying paths 19 and 21.

When using density detection sensors as the skew detection sensors 7, if the sheet PN skews as shown in FIG. 6, or the sheet PN is folded as shown in FIG. 7, there is a time difference between the two density detection sensors for detecting a change in the density, as in the case of the optical sensors. The CPU 801 determines that the fed sheet is an abnormal sheet, based on this time difference.

Since the skew detection sensor 7 can detect the leading edge of a sheet whether the skew detection sensor 7 is an optical sensor or a density detection sensor, the skew detection sensor 7 may also operate as a jam detection sensor. That is, when the sheet P fed from the cassette 114 or 115 is not detected by the skew detection sensors 7 even after the lapse of a predetermined time period after the sheet feeding, the CPU 801 shown in FIG. 2 may determine that a jam occurs at a portion upstream from the skew detection sensors 7, display the location of the generated jam, and urgently stops the apparatus. If the skew detection sensor 7 is caused to also operate as a jam detection sensor, it is possible to reduce the size and the cost of the apparatus by simplifying the structure by omitting the jam detection sensor.

Sometimes, a jam occurs at the skew detection sensor 7, and therefore the skew detection sensor 7 remains to detect the sheet. In such a case, the CPU 801 determines that a jam occurs if a signal indicating continuation of detection of the sheet is received for at least a predetermined time period, displays the location of the jam on the message display 701, and urgently stops the apparatus.

The CPU 801 determines the amount of skew and the amount of a folded portion utilizing a time difference in sheet detection between the two skew detection sensors 7. Accordingly, when a time difference corresponding to the amount of skew or the amount of a folded portion having a possibility of generating a jam in an abnormal sheet is detected at a portion downstream from the skew detection sensor 7, the CPU 801 can display a location where occurrence of a jam is predicted on the message display 701, and urgently stop the apparatus. It is thereby possible to prevent occurrence of a jam, and shorten a time to remove a sheet.

As shown in FIG. 1, the sheet-thickness detection sensor 12 is also provided a the conveying path 19. The sheet-thickness detection sensor 12 detects multiple feeding of sheets, i.e., feeding of a plurality of sheets in a superposed state.

Figure 8:
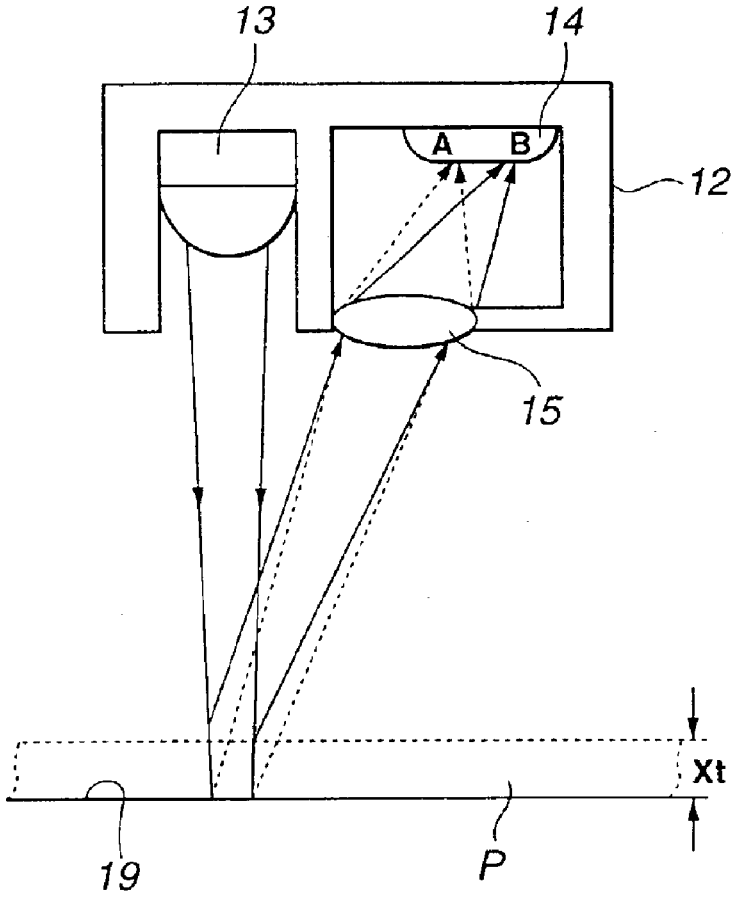
FIG. 8 is a cross-sectional view illustrating as sheet-thickness detection sensor.

As shown in FIG. 8, the sheet-thickness detection sensor 12 includes an LED (light emitting diode) 13, serving as a light emitting device. The LED 13 emits light onto a detection region. The sheet-thickness detection sensor 12 detects the thickness of a sheet by detecting reflected light from the detection region using a lens 15 and a position sensing device (hereinafter abbreviated as a "PSD") 14.

That is, the reflected light from the sheet is condensed onto the PSD 14 by the lens 15. The position illuminated by the condensed reflected light changes depending on the distance to the sheet. That is, reflected light when the sheet is not conveyed illuminates a portion A on the PSD 14, as indicated by broken lines. When the sheet is conveyed, reflected light illuminates a portion B on the PSD 14, as indicated by solid lines. Thus, the position illuminated by the reflected light changes from A to B in FIG. 8 due to the thickness of the sheet.

Figure 9:
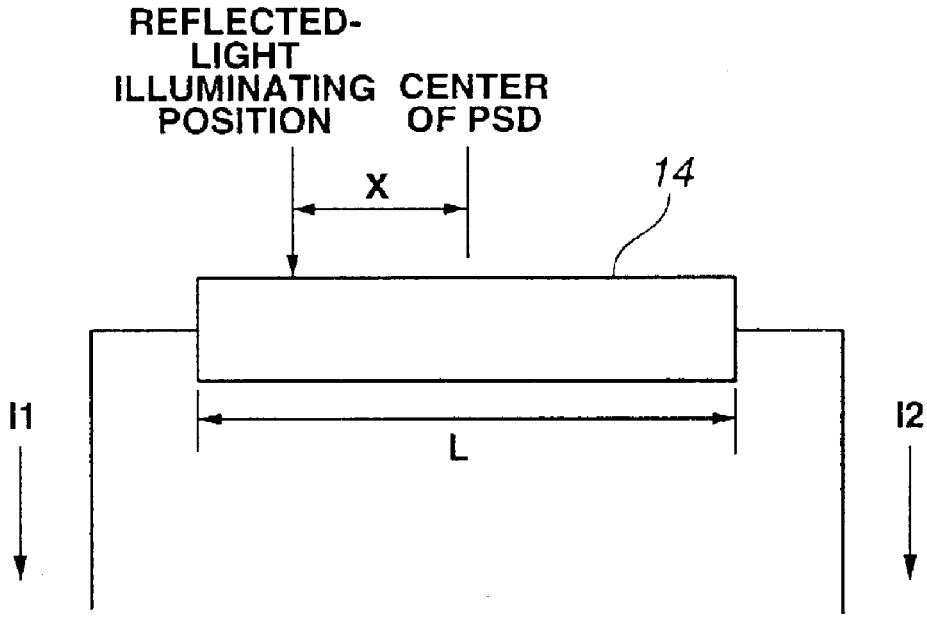
FIG. 9 is a diagram illustrating an operation when the sheet-thickness detection sensor detects the thickness of a sheet.

FIG. 9 illustrates the relationship between an output signal from the PSD 14 and an illuminated position. When output signals from the PSD 14 are represented by I1 and I2, the total length of the PSD is represented by L, and the distance from the center of the PSD 14 to the position illuminated by reflected light is represented by X, the following equation holds:

$$(I1-I2)/(I1+I2)=2X/L.$$

This equation is stored in the ROM 802. The CPU 801 obtains the value of X based on this equation and the output signals I1 and I2 from the PSD 14, and determines the thickness Xt (see FIG. 8) of the sheet. That is, when the Xt is equal to or less than a predetermined value, the CPU 801 determines that only one sheet is conveyed. When the value Xt exceeds the predetermined value, the CPU 801 determines that sheets are subjected to multiple feeding.

When multiple feeding of sheets has been detected, the CPU 800 shifts abnormal sheets subjected to multiple feeding in a direction crossing the sheet discharging direction by operating the shifter 1704, so that abnormal sheets can be visually discriminated from normal sheets. The CPU 801 also displays which sheets counted from the last sheet or from the leading sheet of sheets discharged onto the tray 701 are subjected to multiple feeding, on the message display 701.

Thus, the copier 100 can cause the user to discriminate between abnormal sheets subjected to multiplex feeding and normal sheets, by shifted discharge of the abnormal sheets and message display.

Although in the foregoing description, the CPU 801 operates the shifter 1704 and performs the message display 701, the CPU 801 is not necessarily required to perform the two operations. Even if only one of the operations is performed, the CPU 801 can cause the user to discriminate abnormal sheets from normal sheets. In this case, the copier 100 is required to have only a mechanism necessary for the one operation.

Since the sheet-thickness detection sensor 12 can detects the leading edge of a sheet, the sheet-thickness detection sensor 13 may also operate as a jam detection sensor. That is, when the sheet P fed form the cassette 114 or 115 is not detected by the sheet-thickness detection sensor 12 even after the lapse of a predetermined time period after being fed, the CPU 800 shown in FIG. 2 may determine that a jam occurs at a portion upstream from the sheet-thickness detection sensor 12, display the location of the jam on the message display 701, and urgently stop the apparatus. If the sheet-thickness detection sensor 12 is caused to also operate as a jam detection sensor, it is possible to reduce the size and the cost of the apparatus by simplifying the structure by omitting the jam detection sensor.

Sometimes, a jam occurs at the sheet-thickness detection sensor 12, and therefore the sheet-thickness detection sensor 12 remains to detect the sheet. In such a case, the CPU 801 determines that a jam occurs if a signal indicating continuation of detection of the sheet is received for at least a predetermined time period, displays the location of the jam on the message display 701, and urgently stops the apparatus.

(Explanation of an Outline of the Operation of the Entire Copier)

FIG. 12 is a flowchart illustrating control of sheet conveyance executed by the CPU 801. First, a sheet is supplied from the cassette 114 or 115, or the manual sheet feeding unit 125 in accordance with an instruction from the CPU 800 (step S1001). When the jam detection sensor 16 does not detect passage of the sheet even after the lapse of a predetermined time period after the sheet has been supplied, the CPU 801 determines that a jam occurs in the sheet (step S1002), displays the location of the jam on the LCD 701, and urgently stops the apparatus (step S1003).

When the jam detection sensor 16 has detected the sheet before the lapse of the predetermined time period, it is determined that a jam is not generated, and the sheet reaches the skew detection sensor 7. The skew detection sensor 7 determines whether or not skew or a folded portion occurs in the sheet after passing through the pair of registration rollers 150. Then, the sheet-thickness detection sensor 12 measures the thickness of the sheet, and detects whether or not the sheet has a predetermined thickness, i.e., whether or not multiple feeding of sheets is performed (step S1004). Then, formation of an image on the sheet and fixing of the image is performed (step S1005).

After fixing the image, the jam detection sensor 20 detects passage of the sheet (step S1006). When the jam detection sensor 16 does not detect passage of the sheet even after the lapse of a predetermined time period after fixing the image, the CPU 801 determines that a jam occurs, displays the location of the jam on the LCD 701, and urgently stops the apparatus (step S1003).

If the result of the detection in step S1004 indicates skew or a folded corner (step S1107 or step S1008), the CPU 801 provides the abnormal sheet with a mark "NG" by operating the stamp 151 (step S1109). Then, the CPU 801 shifts and discharges the abnormal sheet onto the tray 1701 by operating the sheet discharge unit 1731 (step S1110).

Since a skewed sheet or a folded sheet cannot sometimes be used, the number of sheets is insufficient by the number of abnormal sheets. Accordingly, a recovery operation in which image formation is performed on sheets whose number equals the number of insufficient sheets is necessary. When recovery for the insufficient number of sheets has been selected in advance through the recovery key 619 (step S1111), a recovery operation is started (step S1001). When a recovery operation has not been selected, copying operations are performed until copying is completed on sheets whose number equals the insufficient number of sheets (step S1113).

When it is determined in step S1107 that an abnormal sheet is not detected as a result of detection of skew/a folded corner and multiple feeding in step S1004, the sheet is normally discharged (step S1112), and an image forming operation is repeated until copying is completed on sheets whose number has been assigned (steps S1113 and S1001). When the result of detection in step S1004 indicates multiple feeding (steps S1107 and S1108), sheets subjected to multiple feeding are subjected to shifted discharge without providing the sheets with a mark, or causing the copier to perform a recovery operation (step S1114). An image forming operation is repeated until copying is completed on sheets whose number has been assigned (steps S1113 and S1001).

When copying has been completed on the sheets whose number has been assigned (step S1113), and an abnormal sheet has not been detected in step S1004, the image forming operation is terminated. When an abnormal sheet has been detected in step S1004 (step S1115), the CPU 800 displays information relating to the type of abnormality (multiple feeding or skew/a folded corner), and in which of copies the abnormal sheet is included, and the page of the abnormal sheet (step S1116), and the process is then terminated.

In the foregoing description of jam detection, the case that the sheet does not reach the jam detection sensor even after the lapse of a predetermined time period has been illustrated. However, the situation is the same also in a case in which the jam detection sensor remains to detect a sheet.

Although in the foregoing embodiment, a description has been provided assuming that, when setting of automatic recovery is set by the recovery key 691 in step S1111, a recovery operation is started at that time, the present invention is not limited to such an approach. A recovery operation may be started after completing an image forming job. That is, when automatic recovery has been set through the recovery key 619 in step S1111, the CPU 801 stores image information for a page requiring recovery and page information, and the process proceeds to step S1113. In accordance with determination of an abnormal sheet in step S1115, the CPU 801 may perform a recovery operation based on the image information and the page information stored for recovery, and display in step S1116.

As described above, the copier (image forming apparatus) 100 of the embodiment includes the copying control unit (abnormality-identification control means) 800 for causing the sheet discharge unit (discharge means) 1731 (or 1732) to perform an operation of discharging a sheet P in an abnormal state at a position different from an ordinary sheet discharge position by controlling the sheet discharge unit 1731 (or 1732), when the abnormal sheet P has been detected by the skew detection sensor (abnormality detection means) 7 and/or the sheet-thickness detection sensor (abnormality detection means) 12. Accordingly, the user can discriminate between normal sheets and abnormal sheets based on positions where sheets are discharged, and easily sort abnormal sheets from normal sheets.

The copier 100 of the embodiment includes the copying control unit (abnormality-identification control means) 800 for causing the stamp (marking means) 151 to perform an operation of performing marking on a sheet P in an abnormal state by controlling the stamp 151, when the abnormal sheet P has been detected by the skew detection sensor (abnormality detection means) 7 and/or the sheet-thickness detection sensor (abnormality detection means) 12. Accordingly, the user can discriminate between normal sheets and abnormal sheets based on a mark provided on a sheet, and easily sort abnormal sheets from normal sheets.

The copier 100 of the embodiment includes the copying control unit (abnormality-identification control means) 800 for causing the message display (display means) 701 that a sheet P in an abnormal state is mounted on the tray (sheet mounting means) 1701 by controlling the message display (display means) 701, when the abnormal sheet P has been detected by the skew detection sensor (abnormality detection means) 7 and/or the sheet-thickness detection sensor (abnormality detection means) 12. Accordingly, the user can know the presence of the abnormal sheet by seeing the message display 701, and easily sort abnormal sheets from normal sheets.

The copier 100 of the embodiment includes the copying control unit (abnormality-identification control means) 800 for causing the stamp 151 to perform an operation of performing marking on a sheet P in an abnormal state by controlling the stamp 151, and causing the sheet discharge unit 1731 (or 1732) to perform an operation of discharging the abnormal sheet P at a position different from an ordinary sheet discharge position by controlling the sheet discharge unit 1731 (or 1732), when the abnormal sheet P has been detected by the skew detection sensor (abnormality detection means) 7 and/or the sheet-thickness detection sensor (abnormality detection means) 12. Accordingly, the user can discriminate between normal sheets and abnormal sheets based on a mark provided on a sheet, and positions where sheets are discharged, and easily sort abnormal sheets from normal sheets.

The copier 100 of the embodiment includes the copying control unit (abnormality-identification control means) 800 for causing the sheet discharge unit (discharge means) 1731 (or 1732) to perform an operation of discharging a sheet P in an abnormal state at a position different from an ordinary sheet discharge position by controlling the sheet discharge unit 1731 (or 1732), and for causing the message display (display means) 701 to perform the display that the abnormal sheet is mounted on the tray 1701 by controlling the message display 701, when the abnormal sheet P has been detected by the skew detection sensor (abnormality detection means) 7 and/or the sheet-thickness detection sensor (abnormality detection means) 12. Accordingly, the user can discriminate between normal sheets and abnormal sheets based on a mark provided on a sheet, and easily sort abnormal sheets from normal sheets by knowing that an abnormal sheet is present by seeing the message display 1701.

The copier 100 of the embodiment includes the copying control unit (abnormality-identification control means) 800 for causing the stamp 151 to perform an operation of performing marking on a sheet P in an abnormal state by controlling the stamp 151, and for causing the message display 701 to perform the display that the abnormal sheet P is mounted on the tray 1701 by controlling the message display 701, when the abnormal sheet P has been detected by the skew detection sensor (abnormality detection means) 7 and/or the sheet-thickness detection sensor (abnormality detection means) 12. Accordingly, the user can discriminate between normal sheets and abnormal sheets based on a mark provided on a sheet, and can know the presence of the abnormal sheet by seeing the message display 701, and easily sort abnormal sheets from normal sheets.

The copier 100 of the embodiment includes the copying control unit (abnormality-identification control means) 800 for causing the stamp 151 to perform an operation of performing marking on a sheet P in an abnormal state by controlling the stamp 151, for causing the sheet discharge unit 1731 (or 1732) to perform an operation of discharging the abnormal sheet P at a position different from an ordinary sheet discharge position by controlling the sheet discharge unit 1731 (or 1732), and for causing the message display 701 to perform the display that the abnormal sheet P is mounted on the tray 1701 by controlling the message display 701, when the abnormal sheet has been detected by the skew detection sensor (abnormality detection means) 7 and/or the sheet-thickness detection sensor (abnormality detection means) 12. Accordingly, the user can discriminate between normal sheets and abnormal sheets based on a mark provided on a sheet, and positions where sheets are discharged, and can know the presence of the abnormal sheet by seeing the message display 701, and easily sort abnormal sheets from normal sheets.

The copying control unit 800 causes the copier 100 to perform a recovery image forming operation in which an image is formed on each of sheets whose number equals the number of abnormal sheets P detected by the skew detection sensor 7 and/or the sheet-thickness detection sensor 12. Accordingly, sheets whose number equals the number of insufficient sheets produced due to abnormal states can be automatically replenished, and therefore it is unnecessary to newly perform an operation of forming images on sheets whose number equals the number of insufficient sheets, and it is possible to improve the efficiency of image formation.

In the copier 100, the skew detection sensor 7 and/or the sheet-thickness detection sensor 12 detects the position of a downstream end of the sheet P. Accordingly, an abnormal state of the sheet can be detected at an early stage.

In the copier 100, each of the skew detection sensor 7 and/or the sheet-thickness detection sensor 12 also operates as a jam detection sensor for detecting a jam of a sheet P. Accordingly, it is possible to provide a simple structure, thereby to reduce the size and the cost of the apparatus.

In the copier 100, the skew detection sensor 7 is a density detection sensor for detecting the position of a downstream end of a sheet P by detecting the difference between the density of the conveying path (density comparing member) 19 and the density of the sheet P. Accordingly, it is possible to detect an abnormal state of the sheet P at an early stage.

Since the copier 100 uses the conveying path 19 as a reference of the density for the skew detection sensor 7, it is unnecessary to separately provide a member serving as a reference of the density, and therefore it is possible to provide a simple structure.

In the copier 100, the sheet-thickness detection sensor 12 also operates as a jam detection sensor for detecting a jam of the sheet P. Accordingly, it is possible to provide a simple structure, and reduce the size and the cost of the apparatus.

In the copier 100, the sheet discharge unit 1731 (or 1732) discharges a sheet P in an abnormal state in a direction crossing the sheet conveying direction. Accordingly, it is possible to exactly determine the position of discharge of the abnormal sheet P, and assuredly perform identification.

The individual components shown in outline or designated by blocks in the drawings are all well known in the image forming apparatus arts and their specific construction and operation are not critical to the operation or the best mode for carrying out the invention.

While the present invention has been described with respect to what is presently considered to be the preferred embodiment, it is to be understood that the invention is not limited to the disclosed embodiment. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus comprising:

an image forming unit adapted to form an image on a sheet;

a first sensor adapted to detect skew or a folded corner of a sheet being conveyed;

a second sensor adapted to detect multiple feeding of sheets being conveyed;

a discharge unit adapted to stack the skewed sheet, the sheet having the folded corner and the sheets subjected to multiple feeding together with other sheets; and a notification unit adapted to notify results of detection of said first sensor and said second sensor, wherein said notification unit notifies a position where the skewed sheet, the sheet having the folded corner and the sheets subjected to multiple feeding exist in a bundle of stacked sheets.

2. An image forming apparatus according to claim 1, wherein said notification unit performs notification by means of display.

3. An image forming apparatus according to claim 1, wherein said notification unit notifies pages where the skewed sheet, the sheet having the folded corner and the sheets subjected to multiple feeding exist in the bundle of stacked sheets.

4. An image forming apparatus according to claim 3, wherein said notification unit notifies a sheet bundle where the skewed sheet, the sheet having the folded corner and the sheets subjected to multiple feeding exist, from among a plurality of bundles of stacked sheets.

5. An image forming apparatus comprising:

an image forming unit adapted to form an image on a sheet;

a first sensor adapted to detect skew or a folded corner of a sheet being conveyed;

a second sensor adanted to detect multiple feeding of sheets being conveyed;

a discharge unit adapted to stack the skewed sheet, the sheet having the folded corner and the sheets subjected to multiple feeding together with other sheets; and a notification unit adapted to notify results of detection of said first sensor and said second sensor, wherein said discharge unit shifts the sheet for which said first sensor has detected skew or the folded corner, and the sheets for which said second sensor has detected multiple feeding so that the shifted sheets can be discriminated from the other sheets in the bundle of stacked sheets.

6. An image forming apparatus according to claim 1, further comprising:

an image provision unit adapted to provide the sheet for which said first sensor has detected skew or the folded corner with a predetermined image.

7. An image forming apparatus according to claim 1, wherein said image forming unit performs an operation of recovering image formation, in accordance with detection of skew or the folded corner by said first sensor.

8. An image forming apparatus according to claim 7, wherein said image forming unit does not perform an operation of recovering image formation, when multiple feeding has been detected by said second sensor.

9. A sheet processing apparatus comprising:

a first sensor adapted to detect skew or a folded corner of a sheet being conveyed;

a second sensor adapted to detect multiple feeding of sheets being conveyed;

a discharge unit adapted to stack the skewed sheet, the sheet having the folded corner and the sheets subjected to multiple feeding together with other sheets; and a notification unit adapted to notify results of detection of said first sensor and said second sensor, wherein said notification unit notifies a position where the skewed sheet, the sheet having the folded corner and the sheets subjected to multiple feeding exist in a bundle of stacked sheets.

10. A sheet processing apparatus comprising:

a first sensor adapted to detect skew or a folded corner of a sheet being conveyed;

a second sensor adapted to detect multiple feeding of sheets being conveyed;

a discharge unit adapted to stack the skewed sheet, the sheet having the folded corner and the sheets subjected to multiple feeding together with other sheets; and a notification unit adapted to notify results of detection of said first sensor and said second sensor, wherein said discharge unit shifts the sheet for which said first sensor has detected skew or the folded corner, and the sheets for which said second sensor has detected multiple feeding so that the shifted sheets can be discriminated from the other sheets in the bundle of stacked sheets.

* * * * *

UNITED STATES PATENT AND TRADEMARK OFFICE

CERTIFICATE OF CORRECTION

PATENT NO. : 6,898,382 B2
DATED : May 24, 2005
INVENTOR(S) : Seiji Shibaki

It is certified that error appears in the above-identified patent and that said Letters Patent is hereby corrected as shown below:

Column 3,
Line 44, "cassettes 14" should read -- cassettes 114 --.

Column 4,
Line 43, "An" should read -- A --.

Column 6,
Lines 40 and 54, "CPU 800" should read -- CPU 801 --; and
Line 54, "likes." should read -- lines. --.

Column 7,
Line 37, "CPU 800" should read -- CPU 801 --.
Line 42, "respect" should read -- respect to --.
Line 55, "lam" should read -- jam --.

Column 9,
Line 39, "copier 100" should read -- copier 100 does --.

Column 11,
Lines 4, 30 and 51, "CPU 800" should read -- CPU 801 --.
Line 24, "detects" should read -- detect --.
Line 27, "form" should read -- from --.

Column 12,
Line 46, "CPU 800" should read -- CPU 801 --.

UNITED STATES PATENT AND TRADEMARK OFFICE

CERTIFICATE OF CORRECTION

PATENT NO. : 6,898,382 B2
DATED : May 24, 2005
INVENTOR(S) : Seiji Shibaki

It is certified that error appears in the above-identified patent and that said Letters Patent is hereby corrected as shown below:

Column 16,
Line 3, “adanted” should read -- adapted --.

Signed and Sealed this

Thirteenth Day of September, 2005

JON W. DUDAS
*Director of the United States Patent and Trademark Office*